US005199422A

United States Patent [19]

Rasocha

[11] Patent Number: 5,199,422

[45] Date of Patent: Apr. 6, 1993

[54] MODULAR SNORKEL

[75] Inventor: Stan Rasocha, Deerfield, Ill.

[73] Assignee: Dacor Corporation, Northfield, Ill.

[21] Appl. No.: 766,053

[22] Filed: Sep. 26, 1991

[51] Int. Cl.[5] ..... B63C 11/16

[52] U.S. Cl. ..... 128/201.11; 128/205.24

[58] Field of Search ..... 128/201.11, 207.16, 128/207.12, 200.29, 201.27, 205.24, 201.26, 201.28, 207.14; 2/422, 2.1 R

[56] References Cited

U.S. PATENT DOCUMENTS

| | | | |
|---|---|---|---|
| 2,359,008 | 9/1944 | Smith | 128/207.12 X |
| 2,534,568 | 12/1950 | Bedini et al. | 128/201.11 |
| 2,753,865 | 7/1956 | van der Kogel | 128/128.11 |
| 3,051,170 | 8/1962 | Benzel | 128/201.11 |
| 3,768,504 | 10/1973 | Rentsch, Jr. | 128/201.11 X |
| 3,860,042 | 1/1975 | Green | 128/201.11 |
| 3,908,647 | 9/1975 | Taunton | 128/201.11 |
| 3,993,060 | 11/1976 | Mitchell | 128/201.11 |
| 4,061,140 | 12/1977 | Saito | 128/201.11 |
| 4,071,024 | 1/1978 | Blanc | 128/201.11 |
| 4,278,080 | 7/1981 | Schuch | 128/201.11 |
| 4,562,836 | 1/1986 | Perron | 128/201.11 |
| 4,610,246 | 9/1986 | Delphia | 128/201.11 |
| 4,655,212 | 4/1987 | Delphia | 128/201.11 |
| 4,759,356 | 7/1988 | Muir | 128/207.16 |
| 4,805,610 | 2/1989 | Hunt | 128/201.11 |
| 4,834,084 | 5/1989 | Walsh | 128/201.11 |
| 4,860,739 | 8/1989 | Vandepol | 128/201.11 |
| 4,872,453 | 10/1989 | Christianson | 128/201.11 |
| 4,877,022 | 10/1989 | Christianson | 128/201.11 |
| 4,879,995 | 11/1989 | Christianson | 128/201.11 |
| 4,884,564 | 12/1989 | Lamont | 128/201.11 |
| 4,907,582 | 3/1990 | Meyerrose | 128/201.11 |
| 4,928,710 | 5/1990 | Campbell | 128/201.11 X |
| 5,020,191 | 6/1991 | Uke | 128/201.11 X |

FOREIGN PATENT DOCUMENTS

| | | | |
|---|---|---|---|
| 712617 | 9/1966 | Italy | 128/201.11 |
| 312092 | 6/1969 | Sweden | 128/201.11 |
| 2185888 | 8/1987 | United Kingdom | 128/201.11 |

OTHER PUBLICATIONS

Advertisement for "Dacor Snorkels", May 21, 1973, pp. 20 and 21.

*Primary Examiner*—William H. Grieb
*Assistant Examiner*—Sebastiano Passaniti
*Attorney, Agent, or Firm*—Welsh & Katz, Ltd.

[57] ABSTRACT

A modular snorkel includes a breathing tube, a snorkel body, a connector tube matingly and sealingly connecting the tube and the body. The breathing tube is rotatable relative to the snorkel body and has a plurality of vertically spaced ribs to which a mask strap retainer may be releasably secured in vertically adjustable, rotatable relationship. A valve located at the upper end of the breathing tube includes a valve housing configured to permit the free flow of air and the exhaustion of water from the tube, while restricting the entry of water into the breathing tube, especially due to splashing. The valve housing also includes a depending deflector to direct water purged from the upper end of the breathing tube towards and out the valve. The connector tube sealingly connects the breathing tube with the snorkel body solely through a friction fit. The snorkel body may be vented at a lower end to facilitate the release of trapped water.

20 Claims, 2 Drawing Sheets

MODULAR SNORKEL

BACKGROUND OF THE INVENTION

The present invention relates to a fresh air diving snorkel of the type used in the sport of skin diving, and particularly to a snorkel which can be manufactured of a plurality of interchangeable, modular components to create a variety of snorkel configurations.

A common problem of conventional diving snorkels is that undue effort is required by the diver in exhausting water from the snorkel which has entered through underwater swimming, or through splashing due to waves or swimming near the surface. Another common problem of conventional snorkels is that the breathing tube causes a dragging force when the diver swims underwater. Such drag is exacerbated when the snorkel is provided with extra-tubular structures, such as conventional splash restrictors or exhaust valves externally mounted in operational relationship to the beathing tube.

Another problem of conventional snorkels is that devices used to prevent water from entering the breathing tube while the diver is swimming near the surface often excessively restrict the flow of air, and are mechanically complex, making them susceptible to breakage as well as high manufacturing costs. Some snorkel designers have attempted to cut costs by providing all or part of the breathing tube in a material which is flexible and inexpensive. Unfortunately, such snorkels are susceptible to collapse of the flexible tubing when the diver swims underwater.

Yet another problem of conventional snorkels is the form of attachment used to secure the breathing tube to the mask. A conventional type of attachment takes the form of a pair of elastic rings joined together by an elastic band to be passed around the strap of the mask. This system is inconvenient because the mouthpiece is kept fixed to the mask in a position which cannot be easily changed or adjusted, while it is often necessary to remove the mouthpiece from the diver's mouth, as is required, for example, is changing from a mouthpiece breathing system to an auto-respirator system. Another drawback is that it tends to pull the hair of the diver when he is not wearing a diving hood. The elastic rings generally do not last very long since they are pulled or stretched quite often, particularly when the mouthpiece of the breathing tube is inserted into the mouth or removed therefrom. Moreover, since these rings exert a gripping action on the tube and thus cannot be readily moved therealong for adjustment, the breathing tube is often misheld and/or mispositioned and, as a consequence, the tube undergoes vibration as the diver swims and water may be more easily admitted thereinto. If the breathing tube is improperly positioned, the mouthpiece has a tendency to spring away from the mouth, resulting in inconvenience to the diver as well as discomfort.

Thus, an object of the present invention is to provide a snorkel which is designed to minimize diver effort in exhausting water from the breathing tube.

Another object of the present invention is to provide a splash protection device for preventing the unwanted entry of water into the breathing tube, while minimizing the drag the device creates for the diver while swimming underwater.

An additional object of the present invention is to provide a snorkel which is simple, durable and relatively inexpensive to manufacture, and which may be provided in several different configurations depending on the needs and budget of the diver.

Yet another object of the present invention is to provide a snorkel having a mask strap attachment device which is durable and is lockably adjustable in several directions for maximization of diver comfort.

SUMMARY OF THE INVENTION

Accordingly, the above-identified objects are achieved in the present modular snorkel which may be assembled in various configurations depending on which of the interchangeable components is selected. The snorkel includes a breathing tube, a snorkel body, and a connector tube matingly and sealingly connecting the tube and the body. The breathing tube has a plurality of vertically spaced ribs to which a mask strap retainer may be releasably secured in vertically adjustable, rotatable relationship. The mask strap retainer preferably swivels to allow the snorkel to be displaced from the diver's mouth when not in use. As an optional modular element, the invention features a valve located at the upper end of the breathing tube which includes a valve housing configured to permit the free flow of air while restricting the entry of water into the breathing tube, especially due to wave splash. The valve housing also includes a depending deflector to direct water purged from the upper end of the breathing tube out the valve. A further modular element provided by the present modular snorkel is that the snorkel body may be provided in a vented or non-vented configuration. When vented, the snorkel body is provided with a drain valve at a lower end to facilitate the release of trapped water.

Another modular component is the connector tube, which sealingly connects the breathing tube to the snorkel body by a friction fit without the use of supplemental sealing devices, such as adhesives or O-rings. The connector tube may be provided as a semi-rigid elbow, or a relatively flexible, corrugated tube.

More specifically, the present snorkel includes a breathing tube, a valve assembly disposed at an upper end of the breathing tube for permitting the unrestricted flow of air into and out of the tube and the exhaustion of water from the tube, and for restricting the entry of water into the tube, and a snorkel body provided with a passageway being in fluid communication with the breathing tube.

In another embodiment, the present invention includes an upper valve for a snorkel having a breathing tube, a snorkel body and a mouthpiece, the breathing tube having an upper end and a lower end, the lower end being in fluid communication with the snorkel body, the mouthpiece being in fluid communication with the snorkel body, the upper valve including a valve disposed at the upper end of the breathing tube for permitting the unrestricted flow of air into and out of the tube and the exhaustion of water from the tube, and for restricting the entry of water into the tube.

Still another embodiment of the present snorkel includes a breathing tube having an upper end and a lower end, a plurality of vertically spaced annular ribs disposed on the tube adjacent the lower end, a snorkel body provided with a passageway having an upper end, a connector for sealingly connecting the lower end of the breathing tube to the upper end of the snorkel body, a mouthpiece connected to the body and being in fluid communication with the passageway, and a mask strap retainer for retaining the snorkel to a mask strap, the retainer including a tubular barrel circumscribing and being vertically adjustable relative to the breathing tube, the barrel being configured for releasable locking engagement with at least one of the ribs to maintain the vertical position of the barrel relative to the breathing tube, the retainer also including a strap portion swivellingly secured to the tubular barrel and configured to releasably retain a mask strap therein.

Yet another embodiment of the present snorkel includes a breathing tube having an upper end and a lower end, a snorkel body having an upper end and a lower end and provided with a passageway being in fluid communication with the breathing tube, and a connector for sealingly connecting the lower end of the breathing tube to the upper end of the snorkel body, the connector being provided with structure for orienting the connector relative to the breathing tube in a plurality of secured, slip resistant positions.

A further embodiment of the present snorkel includes a breathing tube having an upper end and a lower end, a snorkel body provided with a passageway being in fluid communication with the breathing tube, the body having an upper end and a lower end, and a drain valve located at the lower end of the body and including a housing configured to frictionally and sealingly engage the lower end of the body to position the housing at a vertically depending position while the snorkel is worn by a diver.

DETAILED DESCRIPTION OF THE PREFERRED EMBODIMENT

Figure 1:
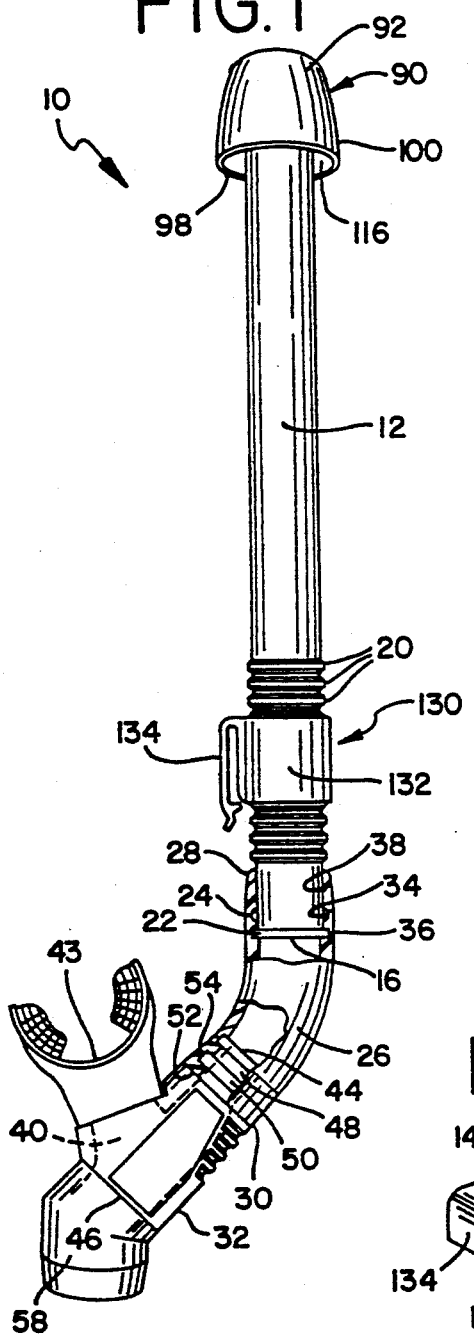
FIG. 1 is a front elevational view of the present modular snorkel, with portions shown cut away for clarity.
Figure 2:
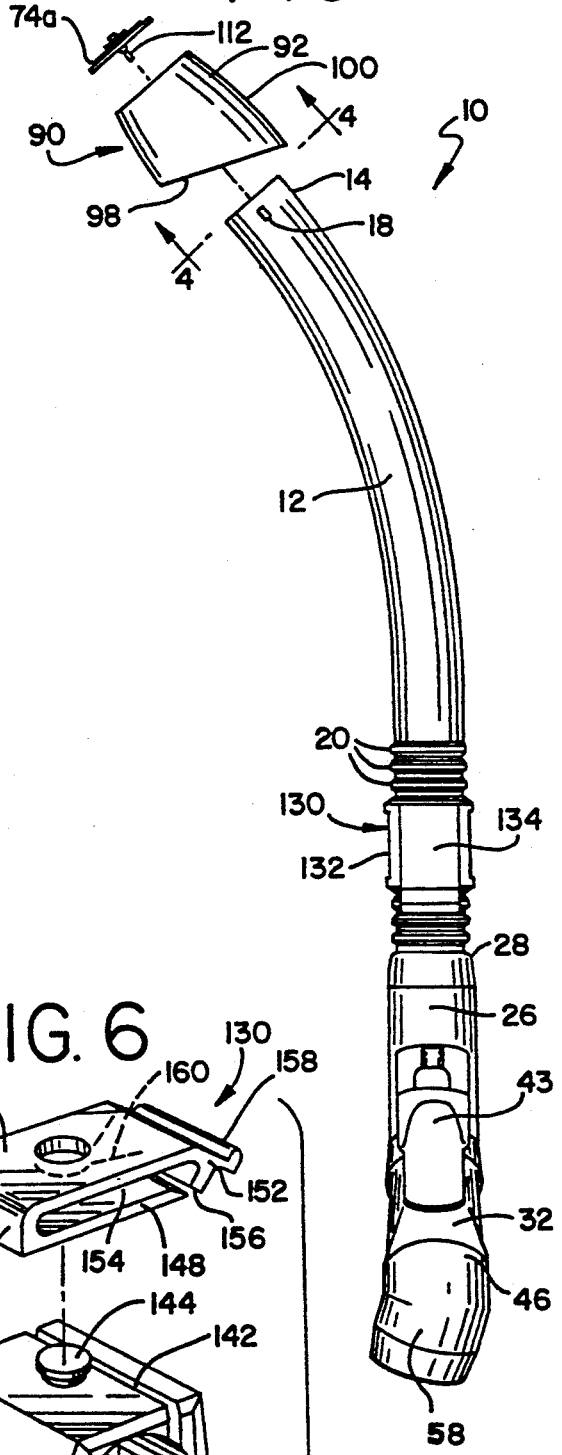
FIG. 2 is a side elevational view of the snorkel of FIG. 1, with the upper valve assembly shown exploded.

Referring now to FIGS. 1 and 2, the present snorkel is generally indicated at 10. The snorkel 10 includes a breathing tube 12 having an upper end 14 and a lower end 16, both of which are open. The breathing tube 12 may be made of any self-supporting material having the characteristics of slight flexibility, chemical and ultraviolet resistance, scuff and mar resistance, and the ability to be produced in a variety of distinctive colors. A preferred material for the breathing tube 12 is semi-rigid polyurethane.

At least one and preferably two mounting openings 18 are located adjacent the upper end 14. A plurality of vertically spaced annular ribs 20 are disposed on the breathing tube 12 adjacent the lower end 16. The ribs 20 define a band having a generally corrugated appearance. The lower end 16 of the tube 12 is preferably provided with a radially extending lip 22 and at least one retention nodule 24. In the present invention, two, diametrically opposed nodules 24 are provided. Above the ribs 20, the breathing tube 12 has a slightly sweeping, curved configuration, and it is contemplated that the degree and direction of curve may vary as desired; however, it is preferred that the tube have a slightly swept back profile to minimize drag when swimming underwater.

A connector tube 26 matingly engages the lower end 16 of the breathing tube 12 and has an upper end 28 and a lower end 30. The lower end 30 matingly engages the snorkel body 32 to place the breathing tube 12 and the snorkel body in fluid communication with each other, as well as to physically connect the two components.

The connector tube 26 is preferably made of a relatively soft synthetic material which will be self sealing when frictionally pressed upon and over the corresponding mating portions of the breathing tube 12 and the snorkel body 32. In other words, special adhesives, O-rings and/or clamps are not needed to prevent water from entering the snorkel at the junction of the connector tube 26 at either the breathing tube 12 or the snorkel body 32. A preferred material for the connector tube 26 is thermoplastic rubber having a hardness in the range of 40–60 Durometer, with 45–55 Durometer being preferred.

An additional advantage of the present connector tube 26 and the manner in which it is mounted to the adjacent components of the snorkel 10, is that the relative flexibility of the connector tube 26 permits the breathing tube 12 to be rotated relative to the snorkel body 32, thus allowing the diver in some applications, to move the tube relative to his face for a better fit around the face, to also switch the tube 12 from one side of his face to the other, and for added comfort. This is an advantage over conventional snorkels, in which the relative positions of the breathing tube and the snorkel body are fixed.

The mating, rotational engagement between the connector tube 26 and the breathing tube 12 is enhanced by the provision of at least one and preferably eight hemispherically-shaped retention recesses 34 and an annual groove 36 formed in an interior surface 38 of the connector tube 26 at the upper end 28. The disposition and shape of the retention recesses 34 are designed to correspond to the similar properties of the retention nodules 24 on the breathing tube 12. The engagement between the nodules 24 and the recesses 34 prevents unwanted rotation of the breathing tube 12 relative to the connector tube 26, due to the tendency of thermoplastic rubber to become slippery under water. Similarly, the annual groove 36 is configured and disposed to matingly engage the annular lip 22 to better secure the breathing tube 12 to the connector tube 26. In the preferred embodiment, the provision of the eight regularly-spaced retention recesses 34 provides the diver with a plurality of available, secured, slip-resistant indexing positions for rotatably orienting the breathing tube 12 relative to the connector tube 26. Each indexing position corresponds to an engagement point between a module 24 and a recess 34.

The snorkel body 32 is provided with a central passageway 40 (shown hidden) which is in fluid communication with the connector tube 26 as well as a mouthpiece attachment port 42. A conventional regulator-style mouthpiece 43 is friction fit upon the attachment port 42 (best seen in FIG. 3). It is contemplated that other conventional mouthpiece styles may be alternatively employed.

The body 32 also has an upper end 44 and a lower end 46. The upper end 44 is configured to matingly engage the lower end 30 of the connector tube 26. Preferably, the upper end 44 of the body 32 is inserted into the lower end 30 of the connector tube, and is provided with an inlet port formation 48 having a diameter which will snugly fit within the connector tube 26. The inlet port formation 48 is preferably provided with at least one and preferably two annular ribs 50 in spaced, parallel relationship to each other to promote a secure, rotatable sealing engagement with the connector tube. A shoulder 52 is formed at the base of the port formation 48 and serves as a stop for the lower end 30 of the connector tube 26.

In similar fashion to the upper end 28 of the connector tube 26, the lower end 30 of the connector tube is preferably configured to enhance the engaged, sealing relationship between the snorkel body 32 and the connector tube. Accordingly, the interior surface 38 of the connector tube 26 at the lower end 30 is provided with a pair of spaced, annular grooves 54 which are dimensioned and positioned to matingly engage the annular ribs 50, and thus create a more positive, sealing relationship between the snorkel body 32 and the connector tube 26.

Figure 3:
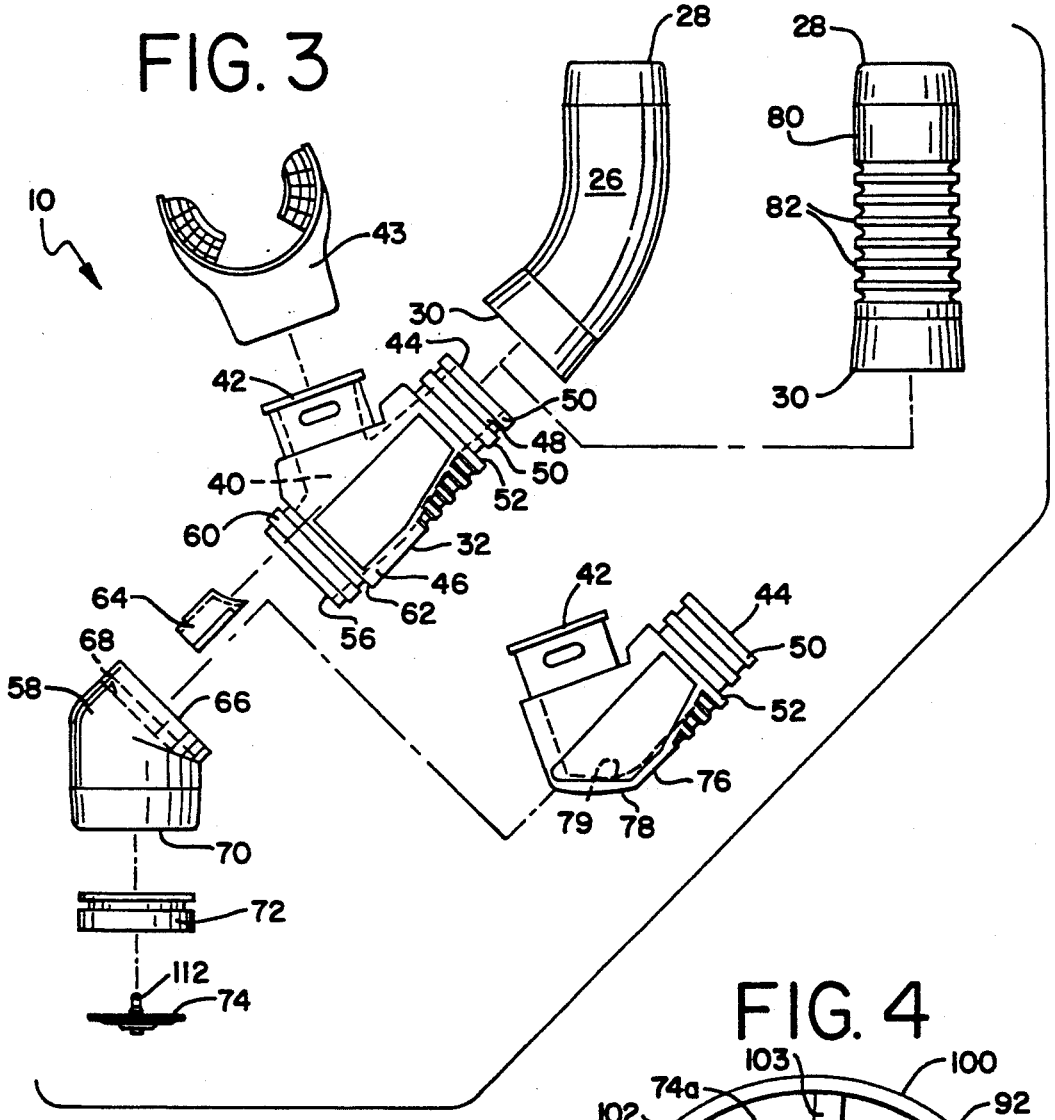
FIG. 3 is an exploded front elevational view of the present modular snorkel, showing alternate components.

Referring now to FIGS. 1-3, the body 32 preferably has, at its lower end 46, a drain port 56 provided with a diameter dimensioned for a friction fit, sealing relationship with a drain valve body 58. The drain port 56 preferably is equipped with at least one annular sealing rib 60 and a shoulder formation 62 which serves as a stop for the drain valve body 58. In addition, the body 32 preferably includes a deflector 64 which is positioned in the central passageway 40 between the mouthpiece attachment port 42 and the drain port 56.

An upper end 66 of the drain valve body 58 is dimensioned to matingly, rotatably and sealingly engage the drain port 56, and preferably includes an annular sealing groove 68 (shown hidden) dimensioned and positioned to matingly engage the annular sealing rib 60. The drain valve body 58, which is preferably made of thermoplastic ribbon having a hardness of approximately 60 Durometer, may thus be pressed upon and over the lower end 46 of the snorkel body 32. In the preferred embodiment, the drain valve body 58 is secured to the snorkel body 32 to depend vertically while the snorkel is worn by a diver. This position optimizes drainage as will be described below. A lower end 70 of the drain valve body 58 is provided with a drain valve seat 72 and a one-way valve disk 74 made of flexible material such as silicone or other similar material having elasticity, chemical, salt and ultraviolet resistance, and nontoxicity. The valve disk 74 is secured to the valve seat 72 to permit fluid such as water to pass from the drain valve body 58, while preventing the flow of fluid into the drain valve body. Such drainage normally occurs as the diver surfaces following underwater swimming.

The present modular snorkel 10 contemplates the substitution in some cases of the body 32, referred to as a vented body due to the presence of the drain valve disk 74, with a so-called non-vented body 76. The non-vented body 76 is identical to the vented body 32, with the exception that a lower end 78 of the non-vented body is closed off, and is not provided with a drain port 56 or a drain valve body 58. Also, instead of a separate deflector 64, the non-vented body 76 is provided with an integrally molded deflector surface 79 (shown hidden) on the interior of the body opposite the mouthpiece attachment port 42. Thus, the non-vented body 76 merely provides fluid communication between the mouthpiece 43 and the connector tube 26. When equipped with the nonvented snorkel body 76, the snorkel 10 may be provided in a more economical commercial format.

Referring now to FIG. 3, in addition to the snorkel bodies 32 and 76, it is contemplated that the connector tube 26 may also be provided in multiple formats. The connector tube 26, also depicted in FIGS. 1 and 2, is a relatively rigid, elbow shaped tube which securely maintains the position of the breathing tube 12 relative to the body 32 or 76. The elbow-type connector tube 26 is preferably made of thermoplastic rubber having a hardness of approximately 50 to 60 Durometer and preferably 55 Durometer.

Alternatively, a more flexible connector tube is depicted at 80, and is preferably made of thermoplastic rubber having a hardness of approximately 40 to 50 Durometer and preferably 45 Durometer. The connector tube 80 is identical to the connector tube 26 with the exception of the hardness of the material and the provision of a plurality of spaced, annular corrugated ribs 82 which enhance the flexibility of the tube, and enable the diver to adjust the position of the breathing tube 12 relative to the mouthpiece 43 on the snorkel body 32, 76 in an almost infinite number of positions. The connector tubes 26 and 80 are interchangeable on the snorkel 10. Also, when the diver releases the mouthpiece 43, the flexible connector tube 80 allows the body 32, 76 to move away from the diver's mouth. The connector tube 80 is constructed and configured to be interchangeable with the connector tube 26, including the provision of sealing grooves and recess formations, and in the rotatability of the breathing tube 12 relative to the tubes 26, 80.

Figure 4:
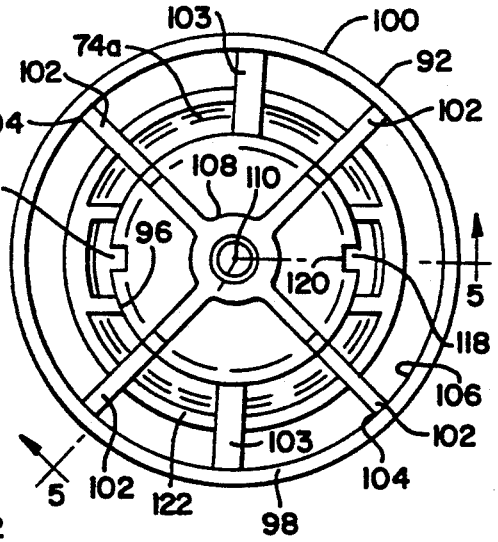
FIG. 4 is a sectional view taken along the line 4–4 of FIG. 2 and in the direction indicated generally.
Figure 5:
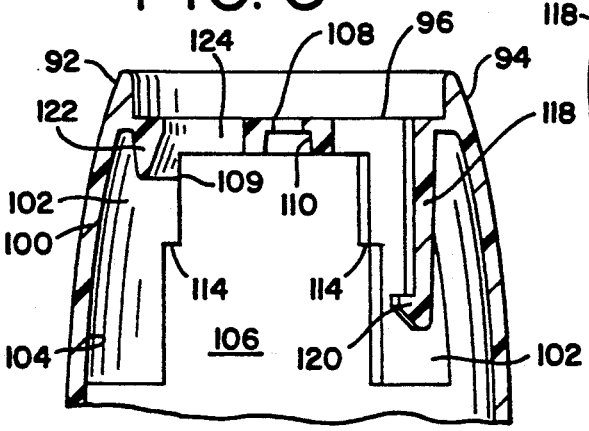
FIG. 5 is a sectional view taken along the line 5—5 of FIG. 4 and in the direction indicated generally, with the valve housing shown inverted to its normal operating orientation.

Referring now to FIGS. 2, 4 and 5, the snorkel 10 may also be equipped with an upper valve, generally designated 90, which is attached to the upper end 14 of the breathing tube 12. The valve 90 includes a valve housing 92 having an upper end 94 defining a valve seat 96, and a lower end 98 provided with an angled shape which becomes parallel to the surface of the water while swimming to reduce drag. The housing 92 is made of plastic material having light weight and durability, low water absorption, high impact resistance, and which may be molded in relatively thin wall sections to "cut" through the water to further reduce drag. In addition, the material for the housing should be dimensionally stable over the temperature ranges commonly experienced during diving to ensure a consistent fit at the valve seat 96.

The valve housing 92 is secured to the breathing tube 12 so that an outer wall 100 is disposed in spaced circumscribing relationship to the open upper end 14 of the breathing tube, and so that the distance between the lower end 98 of the housing and the tube 12 defines an air inlet of comparable volume to the opening of the breathing tube. In order to maintain this spaced relationship to the breathing tube 12, the valve housing 92 is provided with at least one and preferably four support members 102 positioned in the interior of the housing to be at right angles to each other. In addition, a pair of supplemental support members 103 may be provided to support the breathing tube 12.

Each support member 102 is integrally joined at an outer edge 104 to the inner surface 106 of the wall 100, and at an inner edge 108, the support members join to define a mounting aperture 110. The mounting aperture 110 is preferably circular in shape for accommodating a depending lug 112 of a second disc-shaped valve disk 74a, which is identical to the valve disk 74 provided for the drain valve body 58. The valve disk 74a is sealingly positioned upon the valve seat 96 to open as a result of fluid pressure exerted from the upper end 14 of the breathing tube 12. The support members 102 also provide support to the valve disk 74a. It will be appreciated that the valve disk 74 is secured to, and supported by the drain valve seat 72 in similar fashion to the attachment and support provided to the valve disk 74a.

A lower portion 109 of the inner edge 108 of each of the support members 102 is provided with a notch 114 which engages the upper end 14 of the breathing tube 12 to maintain the valve seat 96 in vertically spaced relationship above the breathing tube. Also, the support members 102 are dimensioned so that the distance between the notch 114 and the outer edge 104 defines an air intake space 116 (best seen in FIG. 1) between the breathing tube 12 and the outer wall 100 of the valve housing 92. In this manner, sufficient clearance is provided to allow for adequate air flow into the space 116 and the breathing tube 12. Preferably, the air intake space 116 will have a greater volume than the open upper end 14 of the breathing tube 12. At the same time, the outer wall 100, and the one way valve member 74a prevent water from entering the breathing tube 12 due to splashing from wave action or swimming.

At least one and preferably two fastening tabs 118 depend from an underside of the valve seat 96 for securing the valve housing 92 to the upper end 14 of the breathing tube 12. Each of the tabs 118 has an inwardly projecting tongue 120 which engages the corresponding mounting opening 18 on the breathing tube. In the preferred embodiment, the tabs 118 are integrally molded with the valve housing 92 and exert an inward biasing force toward the breathing tube 12 to enhance their gripping action.

Also depending from the underside of the valve seat 96 is an annular deflector ring 122 having a beveled surface 124 positioned in relation to the upper end 14 of the breathing tube 12 for deflecting water exhausted from the upper end of the tube. The ring 122 is preferably integrally molded with the valve housing 92. Water exhausted from the tube 12 and not flowing through the opened valve disk 74a impacts the beveled surface 124 and is directed toward and out the valve disk 74a.

Figure 6:
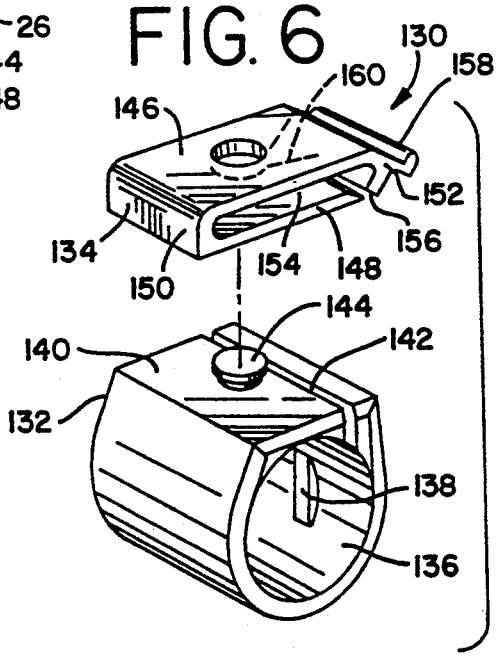
FIG. 6 is an exploded perspective view of the mask strap retaining clip of the type suitable for use with the present modular snorkel.

Referring now to FIG. 6, a mask strap retaining device is generally designated 130, and includes a tubular body 132 and a strap portion 134, both of which are preferably made of a durable, environmentally resistant material such as acetal. The body 132 is generally barrel-shaped and defines a throughbore 136 which is dimensioned to slidingly engage the breathing tube 12, and which is rotatable about the tube upon the exertion of slight force by the diver. A locking key 138 is formed in the throughbore 136 to be transverse to the axis of the throughbore, and is dimensioned to be lockingly engaged between adjacent ribs 20 on the breathing tube 12. In this manner, the vertical position of the device 130 on the breathing tube may be maintained once selected by the diver.

The body 132 also includes a generally flat face 140 upon which the strap portion 134 swivels. A slit 142 is cut into the face 140 to enable the body 132 to be placed upon the breathing tube 12 through lateral pressure without being inserted over the upper end 14. The slit 142 also facilitates vertical adjustment of the device 130 on the breathing tube. A generally cylindrical boss 144 is centrally located on the face 138 to serve as the mounting point, as well as the swivel axis, for the strap portion 134.

The strap portion 134 includes an outer wall 146 and an inner wall 148, which are joined along respective common upper and lower edges 150, 152 in spaced, parallel relationship to each other to define a mask strap passageway 154. The inner wall 148 has a slit 156 to facilitate the insertion of a mask strap into the passageway 154. A finger tab 158 is formed at the lower edge 152 of the outer wall to assist the diver in overcoming the inherent spring force of the strap portion 134. The diver thus spreads apart the inner and outer walls 146, 148 to open the passageway 154 for insertion of the strap. The inner wall 148 is provided with a generally keyhole-shaped opening 160 (shown hidden) dimensioned so that the strap portion may be releasably locked onto the boss 144 for rotation thereabout. Thus, the mask retaining device 130 can rotate 360° about the tube 12, is vertically adjustable on the tube, and the strap portion 134 can also rotate 360° about the body 132.

In operation, the snorkel 10 may be assembled with or without the upper valve 90, with or without the mask strap retaining device 130, with either an elbow-shaped connector tube 26 or a ribbed, relatively flexible connector tube 80, and with either a vented body 32 or a non-vented body 76, depending on the type of snorkel product desired. Also, the type of mouthpiece 43 may be changed to suit a particular application. A significant advantage of the present snorkel is that it may be assembled in its various combinations of components without the use of tools, adhesives or heat.

When in use by a diver, the exceptional adjustability of the mask retaining device 130 relative to the breathing tube 12 allows the diver to quickly and easily achieve the optimum relative positioning between the mask strap and the mouthpiece for maximum comfort. Also, while swimming near the surface of the water, the upper valve housing 92 prevents water from splashing into the upper end 14 of the breathing tube due to the shape of the outer wall 100 and the location of the valve disk 74a. At the same time, the diver may obtain an unrestricted flow of air through the geometry of the air intake space 116. As the diver inhales, air entering the breathing tube 12 gains velocity, and reduces pressure under the valve disk 74a, assisting in the sealing of the disk against the seat 96.

When the diver swims underwater, the configuration of the upper valve 90, and the curved sweep of the breathing tube 12 reduces drag. The angled and very thin leading edge of the outer wall 100 virtually cuts through the water. The water then flows between the breathing tube 12 and the wall 100 and exits through the open valve disk 74a. The exterior wall 100 is smooth and rounded to provide minimum drag during underwater swimming.

Upon surfacing, the breathing tube 12 may be cleared of water by exhaling, which forces water upward in the tube against the valve disk 74a, which opens to let the water escape. The deflector ring 122 directs exhaled water toward and out the valve disk 74a. If the vented snorkel body 32 is employed, as the diver surfaces, water trapped in the lower end 46 of the snorkel body drains through the drain valve 58 once the breathing tube breaks the surface, as is known in the art. The deflector 64 facilitates breathing in the presence of residual water trapped at the bottom of the snorkel body after exhaling. If the non-vented snorkel body 76 is employed, all of the trapped water must be exhaled by the diver, and the deflector surface 79 facilitates exhalation in the presence of trapped residual water in the lower end of the snorkel body.

While a particular embodiment of the modular snorkel of the invention has been shown and described, it will be appreciated by those skilled in the art that changes and modifications may be made thereto without departing from the invention in its broader aspects and as set forth in the following claims.

What is claimed is:

1. A snorkel, comprising:

a breathing tube;

valve means disposed at an upper end of said breathing tube for defining a space for permitting the unrestricted flow of air into and out of said upper end of said tube and the exhaustion of water outward from said upper end of said tube, and including a valve housing having an outer wall configured for preventing the entry of water into said tube during surface swimming, and being secured in relation to said upper end of said tube to define said space for permitting the free flow of air into and out of said tube, and a one-way valve device disposed on said valve housing for facilitating the exhaustion of water outward from said upper end of said tube while preventing the entry of water into said tube through said one-way valve device; and a snorkel body provided with a passageway being in fluid communication with said breathing tube.

2. The snorkel as defined in claim 1 wherein said valve means includes a valve housing having an outer wall disposed in spaced, circumscribing relationship to said upper end of said breathing tube, an open lower end, a valve seat at an upper end of said housing, and a flexible, one-way valve disk secured to said valve seat to prevent the flow of fluid into said tube, while permitting the exhaustion of fluid from said tube.

3. The snorkel as defined in claim 2 wherein said valve housing has an annular deflector depending from said valve seat for directing water exhausted from said upper end of said breathing tube and toward said valve disk.

4. The snorkel as defined in claim 2 wherein said outer wall of said housing has a lower edge which is angled to be generally parallel to the surface of the water when in use.

5. The snorkel as defined in claim 1 further including mask strap retaining means for retaining said snorkel to a mask strap, said retaining means including a tubular barrel circumscribing and being vertically adjustable relative to said breathing tube, said breathing tube being provided with a plurality of radially projecting ribs, said barrel being configured for releasable locking engagement between adjacent ones of said ribs to maintain the vertical position of said barrel relative to said breathing tube.

6. The snorkel as defined in claim 5 further including a strap portion swivellingly secured to said tubular barrel and configured to releasably retain a mask strap therein.

7. The snorkel as defined in claim 1 wherein said snorkel body has a drain valve separate from said valve means for exhausting water trapped in said snorkel.

8. The snorkel as defined in claim 7 wherein said drain valve is located at a lower end of said body, and includes a housing configured to frictionally and sealingly engage said lower end of said body to position said housing at a vertically depending position while said snorkel is worn by a diver.

9. The snorkel as defined in claim 1 further including connector means for connecting said breathing tube and said snorkel body in mating, sealing, rotatable engagement using only the structural characteristics of said connector means.

10. The snorkel as defined in claim 9 wherein said connector means is a connector tube which is relatively flexible.

11. The snorkel as defined in claim 9 wherein said connector means is a connector tube provided in an elbow shape in a relatively stiff material.

12. The snorkel as defined in claim 9 wherein said connector means is a connector tube provided with means for orienting said connector tube relative to said breathing tube in a plurality of secured, indexing slip resistant positions.

13. An upper valve for a snorkel having a breathing tube, a snorkel body and a mouthpiece, the breathing tube having an upper end and a lower end, the lower end being in fluid communication with the snorkel body, the mouthpiece being in fluid communication with the snorkel body, said upper valve comprising:

valve housing means disposed at said upper end of the breathing tube for defining a space for permitting the unrestricted flow of air into and out of said upper end of the tube and the exhaustion of water outward from said upper end of the tube, and including a one-way valve device disposed on an outer surface of said valve housing means for preventing the entry of water into said upper end of the tube through said one-way valve device, during surface swimming and facilitating the exhaustion of water outward from said upper end of said tube.

14. The valve as defined in claim 13 wherein said means includes a valve housing having an outer wall disposed in spaced, circumscribing relationship to the upper end of the breathing tube, an open lower end, a valve seat at an upper end of said housing, and a flexible, one-way valve disk secured to said valve seat to prevent the flow of fluid into the tube, while permitting the exhaustion of fluid from the tube.

15. The valve as defined in claim 14 wherein said valve housing has an annular deflector depending from said valve seat for directing water exhausted from the upper end of the breathing tube and toward said valve disk.

16. The valve as defined in claim 14 wherein said outer wall of said housing has a lower edge which is angled to be generally parallel to the surface of the water when in use.

17. A snorkel, comprising:

a breathing tube having an upper end and a lower end;

a plurality of vertically spaced annular ribs disposed on said tube;

a snorkel body provided with a passageway having an upper end;

connector means for sealingly connecting said lower end of said breathing tube to said upper end of said snorkel body;

a mouthpiece connected to said body and being in fluid communication with said passageway; and mask strap retaining means for retaining said snorkel to a mask strap, said retaining means including a tubular barrel circumscribing and being vertically adjustable relative to said breathing tube, said barrel being configured for releasable locking engagement with at least one of said ribs to maintain the vertical position of said barrel relative to said breathing tube, said retaining means also including a strap portion swivellingly secured to said tubular barrel and configured to releasably retain the mask strap therein.

18. A snorkel, comprising:

a breathing tube having an upper end and a lower end;

a snorkel body having an upper end and a lower end and provided with a passageway being in fluid communication with said breathing tube;

connector means for sealingly connecting said lower end of said breathing tube to said upper end of said snorkel body, said connector means including a connector tube being provided with means for rotatably orienting said connector means relative to said breathing tube in a plurality of secured, indexed, slip resistant positions; and valve means disposed at an upper end of said breathing tube for defining a space for permitting the unrestricted flow of air into and out of said upper end of said tube and the exhaustion of water outward from said upper end of said tube, and including a valve housing having an outer wall configured for preventing the entry of water into said tube during surface swimming, and being secured in relation to said upper end of said tube to define said space for permitting the free flow of air into and out of said tube, and a one-way valve device disposed on said valve housing for facilitating the exhaustion of water outward from said upper end of said tube while preventing the entry of water into said tube through said one-way valve device.

19. The snorkel as defined in claim 18 wherein said lower end of said breathing tube includes at least one retention nodule, and said upper end of said connector means includes a plurality of spaced retention recesses constructed and arranged to releasably engage said nodules as said connector means is oriented relative to said breathing tube, the engagement of one of said recesses by said nodule designating one of said slip resistant positions.

20. A snorkel, comprising:

a breathing tube having an upper end and a lower end;

a plurality of vertically spaced annular ribs disposed on said tube;

mask strap retaining means for retaining said snorkel to a mask strap, said retaining means including a tubular barrel circumscribing and being vertically adjustable relative to said breathing tube, said barrel being configured for releasable locking engagement with at least one of said ribs to maintain the vertical position of said barrel relative to said breathing tube, said retaining means also incuding a strap portion swivellingly secured to said tubular barrel and configured to releasably retain the mask strap therein:

a snorkel body provided with a passageway being in fluid communication with said breathing tube, said body having an upper end and a lower end; and a drain valve located at said lower end of said body and including a housing configured to frictionally and sealingly engage said lower end of said body to position said housing at a vertically depending position while said snorkel is worn by a diver.

* * * * *